US010082008B2

(12) United States Patent
Robey et al.

(10) Patent No.: US 10,082,008 B2
(45) Date of Patent: Sep. 25, 2018

(54) DISSOLVABLE PERFORATING DEVICE

(71) Applicant: Halliburton Energy Services, Inc., Houston, TX (US)

(72) Inventors: Richard Ellis Robey, Mansfield, TX (US); Christopher Hoelscher, Arlington, TX (US); Michael Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/323,921

(22) PCT Filed: Aug. 6, 2014

(86) PCT No.: PCT/US2014/049921
§ 371 (c)(1),
(2) Date: Jan. 4, 2017

(87) PCT Pub. No.: WO2016/022111
PCT Pub. Date: Feb. 11, 2016

(65) Prior Publication Data
US 2017/0175500 A1 Jun. 22, 2017

(51) Int. Cl.
*E21B 43/117* (2006.01)
*F42B 1/032* (2006.01)
*F42B 3/28* (2006.01)

(52) U.S. Cl.
CPC ..... *E21B 43/117* (2013.01); *F42B 1/032* (2013.01); *F42B 3/28* (2013.01)

(58) Field of Classification Search
CPC ..... E21B 43/117
See application file for complete search history.

(56) References Cited

U.S. PATENT DOCUMENTS 6,062,310 A * 5/2000 Wesson ..... E21B 43/117 166/297
8,118,098 B2 2/2012 Hromas et al.
(Continued)

FOREIGN PATENT DOCUMENTS

WO 2012/099585 A1 7/2012

OTHER PUBLICATIONS

International Search Report and Written Opinion issued in related PCT Application No. PCT/US2014/049921 dated May 1, 2015, 12 pages.

(Continued)

*Primary Examiner* — Giovanna C. Wright
*Assistant Examiner* — Kristyn A Hall
(74) *Attorney, Agent, or Firm* — Scott Richardson Baker Botts L.L.P.

(57) ABSTRACT

In accordance with embodiments of the present disclosure, a perforating system for perforating a subterranean formation includes a carrier gun body having a cylindrical sleeve. The perforating system also includes a charge holder disposed in the cylindrical sleeve and a plurality of charges disposed on the charge holder. The charge holder is dissolvable in at least one wellbore fluid delivered through the carrier gun body after detonation of the charges. The charges may also be dissolvable during or after detonation. In some embodiments, the carrier gun body is dissolvable wellbore fluid delivered through the carrier gun body. By including dissolvable parts, the disclosed perforating gun yields relatively lower amounts of debris in the wellbore after detonation. In addition, the dissolving portions of the perforating gun allow the remaining portions of the gun to be used to perform wellbore operations downhole without pulling the perforating gun.

18 Claims, 5 Drawing Sheets

(56) References Cited

U.S. PATENT DOCUMENTS

| | | | | |
|---|---|---|---|---|
| 2010/0147504 | A1 | 6/2010 | King | |
| 2013/0056269 | A1 | 3/2013 | Xu | |
| 2013/0087061 | A1 | 4/2013 | Marya et al. | |
| 2013/0118805 | A1 | 5/2013 | Moody-Stuart et al. | |
| 2013/0192829 | A1* | 8/2013 | Fadul ..... | E21B 43/11 166/297 |
| 2014/0034384 | A1 | 2/2014 | Fadul et al. | |
| 2014/0083764 | A1 | 3/2014 | Fadul et al. | |

OTHER PUBLICATIONS

International Preliminary Report on Patentability issued in related Application No. PCT/US2014/049921, dated Feb. 16, 2017 (9 pages).

* cited by examiner

DISSOLVABLE PERFORATING DEVICE

CROSS-REFERENCE TO RELATED APPLICATION

The present application is a U.S. National Stage Application of International Application No. PCT/US2014/049921 filed Aug. 6, 2014, which is incorporated herein by reference in its entirety for all purposes.

TECHNICAL FIELD

The present disclosure relates generally to well drilling and hydrocarbon recovery operations and, more particularly, to systems and methods for dissolving a perforating device after detonation of the device in hydrocarbon recovery operations.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After drilling a wellbore that intersects a subterranean hydrocarbon-bearing formation, a variety of wellbore tools may be positioned in the wellbore during completion, production, or remedial activities. It is common practice in completing oil and gas wells to set a string of pipe, known as casing, in the well and use a cement sheath around the outside of the casing to isolate the various formations penetrated by the well. To establish fluid communication between the hydrocarbon-bearing formations and the interior of the casing, the casing and cement sheath are perforated, typically using a perforating gun or similar apparatus.

Perforating guns typically establish communication between the formations and interior of the casing through the use of explosives, such as shaped charges, to create one or more openings through the casing. The shaped charges typically include a case, a quantity of high explosive and a liner. In operation, the openings are made by detonating the high explosive which causes the liner to form a jet of particles and high pressure gas that is ejected from the shaped charge at very high velocity. The jet is able to penetrate the casing, thereby forming an opening. The use of such explosives produces a substantial amount of debris, as the internal components of the perforating gun become damaged during the detonation of the charges. If the spent portions of the perforating gun are pulled, drilled out or dropped to the bottom of the wellbore, then the debris can lead to undesirable corrosion and damage to the well or surface equipment. However, pulling the used perforating gun out of the wellbore can increase nonproductive time during well completion, and debris can still fall out of holes in the perforating guns as the guns are pulled through the wellbore. Accordingly, it is now recognized that there exists a need for systems and methods that overcome these drawbacks associated with the debris left from explosive perforating guns.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the invention.

Certain embodiments according to the present disclosure may be directed to perforating systems that are at least partially dissolvable after performing a perforating operation downhole. This makes the perforating system capable of through tubing flow after performing the perforation and without the perforating system being lifted out of the wellbore. Perforating systems generally include a perforating gun that is lowered into the wellbore to perform the perforating operation. Perforating guns generally include a carrier gun body having a cylindrical sleeve, a charge holder disposed in the cylindrical sleeve, and a plurality of charges disposed on the charge holder. The charges are detonated to perform the perforations.

In present embodiments, the charge holder and the plurality of charges are designed to be dissolvable downhole, in order to reduce the amount of debris that might otherwise remain in and negatively affect the wellbore. More specifically, the charge holder may be dissolvable in at least one wellbore fluid delivered through the carrier gun body after detonation of the charges. That way, the detonation of the charges breaks up the charge holder and the charges into smaller pieces, and the wellbore fluid is able to react with each of the pieces to dissolve the charge carrier and the charges. By dissolving the internal components of the perforating gun downhole, the remaining carrier gun body may be utilized to direct fluids or chemical treatments into the formation, or to direct a production flow of formation fluids from the formation up to the surface without having to pull out the tool. In other embodiments, the carrier gun body may be dissolvable in wellbore fluids as well. The partially or fully dissolvable perforating gun may save time, complexity, and money through reduced non-productive time at the rig by effectively managing debris from a perforating operation and facilitating production of formation fluids without the perforating gun being pulled from the wellbore.

Figure 1:
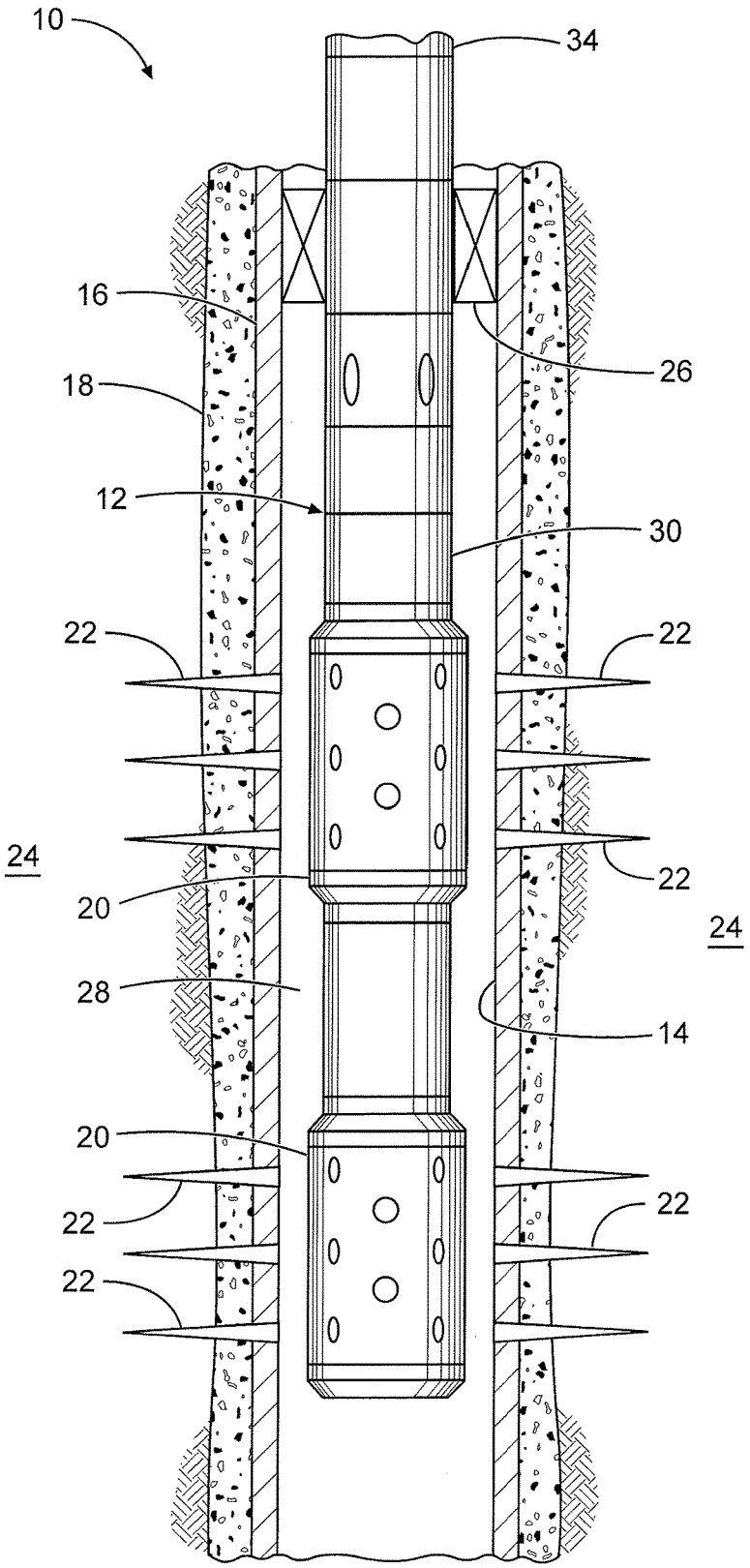
FIG. 1 is a schematic partial cross-sectional view of a perforating system being deployed in a wellbore drilling environment, in accordance with an embodiment of the present disclosure.

Turning now to the drawings, FIG. 1 illustrates a system 10 for use with a hydrocarbon recovery well. In the system 10, a perforating string 12 is positioned in a wellbore 14 lined with casing 16 and cement 18. Perforating guns 20 in the perforating string 12 are positioned opposite predetermined locations for forming perforations 22 through the casing 16 and cement 18, and outward into a subsurface formation 24 surrounding the wellbore 14. The perforating string 12 is sealed and secured in the casing 16 by a packer 26. The packer 26 seals off an annulus 28 formed radially between the perforating string 12 and the wellbore 14. A tubular string 34 (such as a work string, a production tubing string, an injection string, etc.) may be interconnected above the packer 26. It should be noted that, in other embodiments, the perforating string 12 may be lowered into the wellbore 14 via wireline, slickline, or coil tubing. In other embodiments, the perforating string 12 may be flowed into the wellbore 14 via a surface pump, or gravitational attraction.

A firing head 30 is used to initiate firing or detonation of the perforating guns 20 (e.g., in response to a mechanical, hydraulic, electrical, optical or other type of signal, passage of time, etc.), when it is desired to form the perforations 22. Although the firing head 30 is depicted in FIG. 1 as being connected above the perforating guns 20, one or more firing heads may be interconnected in the perforating string 12 at any location, with the location(s) preferably being connected to the perforating guns 20 by a detonation train.

It should be noted that the system 10 of FIG. 1 is merely one example of an unlimited variety of different well systems which can embody principles of this disclosure. Thus, the scope of this disclosure is not limited at all to the details of the well system 10, its associated methods, the perforating string 12, etc. described herein or depicted in the drawings. For example, it is not necessary for the wellbore 14 to be vertical, for there to be two of the perforating guns 20, or for the firing head 30 to be positioned between the perforating guns and the packer 26, etc. Instead, the well system 10 configuration of FIG. 1 is intended merely to illustrate how the principles of this disclosure may be applied to an example perforating string 12, in order to mitigate the effects of debris left over from a perforating event. These principles can be applied to many other examples of well systems and perforating strings, while remaining within the scope of this disclosure.

It will be appreciated that detonation of the perforating guns 20 produces shock which can damage or unset various internal components of the perforating guns 20 themselves, producing undesirable debris within the wellbore 14. In the past, it has been common practice to attempt to reduce or remove an amount of the debris by pulling the perforating string 12 out of the wellbore 14, drilling the perforating string further through the wellbore 14, or dropping the perforating gun 20 into a bottom section of the wellbore 14 after use. However, these techniques often leave a substantial amount of the debris in the wellbore 14, which can complicate further completions performed in the wellbore 14. In addition, while attempts have been made to construct parts of the perforating gun 20 with materials (e.g., zinc) that are reactive with explosives, these materials have been used to form only certain parts (e.g., charge cases) of the perforating gun, while other large components continue to yield undesirable debris within the wellbore 14.

In contrast, the present disclosure relates to ways of dissolving all the internal components of the perforating gun that are damaged during a detonation of the perforating guns 20. This may completely eliminate debris that would otherwise interfere with subsequent work performed in the wellbore 14. In addition, by dissolving the internal components of the perforating guns 20, it may be possible to utilize the perforating string 12 to perform additional downhole tasks without pulling the perforating string 12 out of the wellbore 14.

Figure 2:
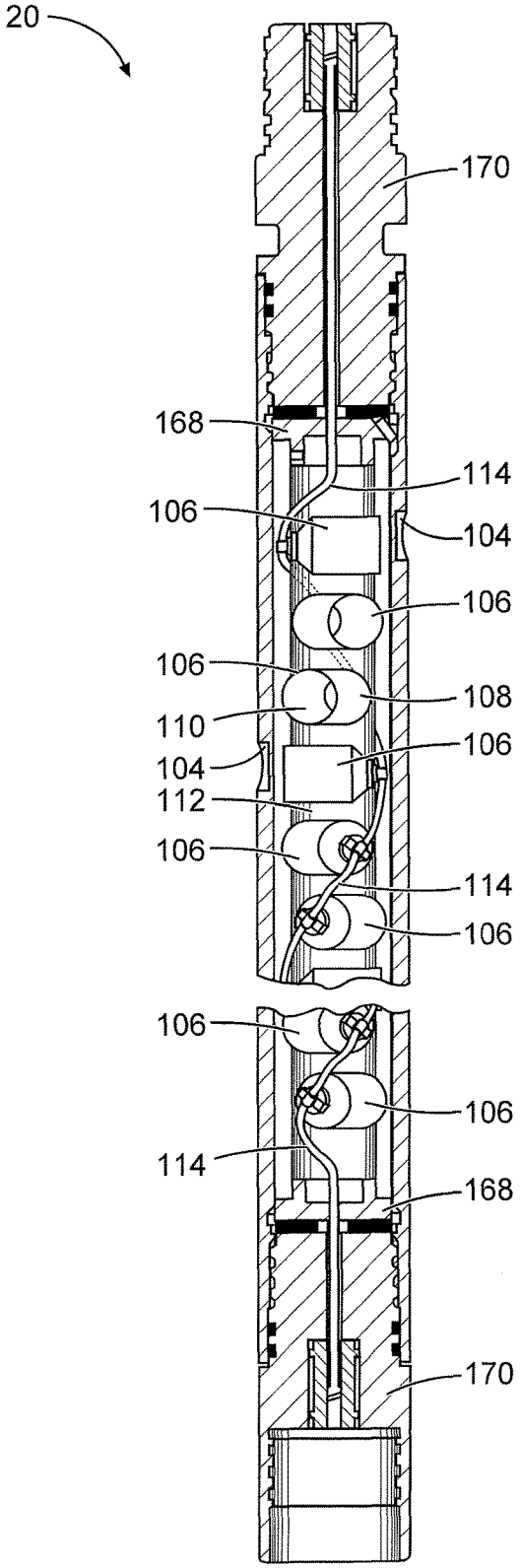
FIG. 2 is a schematic cutaway view of the perforating system of FIG. 1, in accordance with an embodiment of the present disclosure.

Having now discussed the general layout of the perforating string 12 used during well completion, a more detailed description of the components of the perforating gun 20 will be provided. To that end, FIG. 2 depicts one possible assembly of the perforating gun 20 of the present disclosure. The perforating gun 20 includes a carrier gun body 102 made of a cylindrical sleeve having a plurality of radially reduced areas depicted as scallops or recesses 104. In some embodiments, these recesses 104 may be apertures extending through the carrier gun body 102. Radially aligned with each of the recesses 104 is a respective one of a plurality of shaped charges 106, as visible in FIG. 2. Each of the shaped charges 106 includes a charge case 108 and a liner 110. Disposed between each charge case 108 and liner 110 is a quantity of high explosive.

The shaped charges 106 are retained within the carrier gun body 102 by a charge holder 112, which in some embodiments includes an outer charge holder body and an inner charge holder body. Although not shown, in such configurations, the outer tube supports the discharge ends of the shaped charges 106, while the inner tube supports the initiation ends of the shaped charges 106. Disposed within or around the charge holder 112 is a detonator cord 114, such as a Primacord, which is used to detonate the shaped charges 106. In the illustrated embodiment, the initiation ends of the shaped charges 106 extend toward an outer edge of the charge holder 112 opposite the discharge ends, allowing the detonator cord 114 to be wrapped around the charge holder 112. In other embodiments, however, the initiation ends of the shaped charges 106 may each extend across a central longitudinal axis of the perforating gun 20. These orientations of the shaped charges 106 may allow the detonator cord 114 to connect to the high explosive within the shaped charges 106 through an aperture defined at the apex of the charge casings 108 of the shaped charges 106. Any number of other arrangements of the shaped charges 106, charge holder 112, and detonator cord 114 may be utilized in other embodiments of the perforating gun 20 in accordance with the present disclosure.

Figure 3:
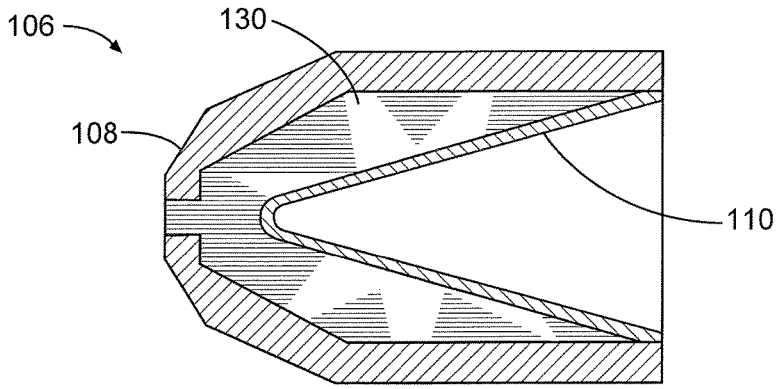
FIG. 3 is a schematic cross-sectional view of a charge that is detonated via the perforating system of FIG. 2, in accordance with an embodiment of the present disclosure.

FIG. 3 is a detailed cross sectional view of one of the shaped charges 106 described above. As previously mentioned, the shaped charge 106 includes the charge casing 108 forming an outer housing of the charge 106 and the liner 110 forming an inner housing of the charge 106. Between the charge casing 108 and the liner 110 is a high explosive powder 130 that may be detonated via the detonator cord 114 of FIG. 2.

Figure 4:
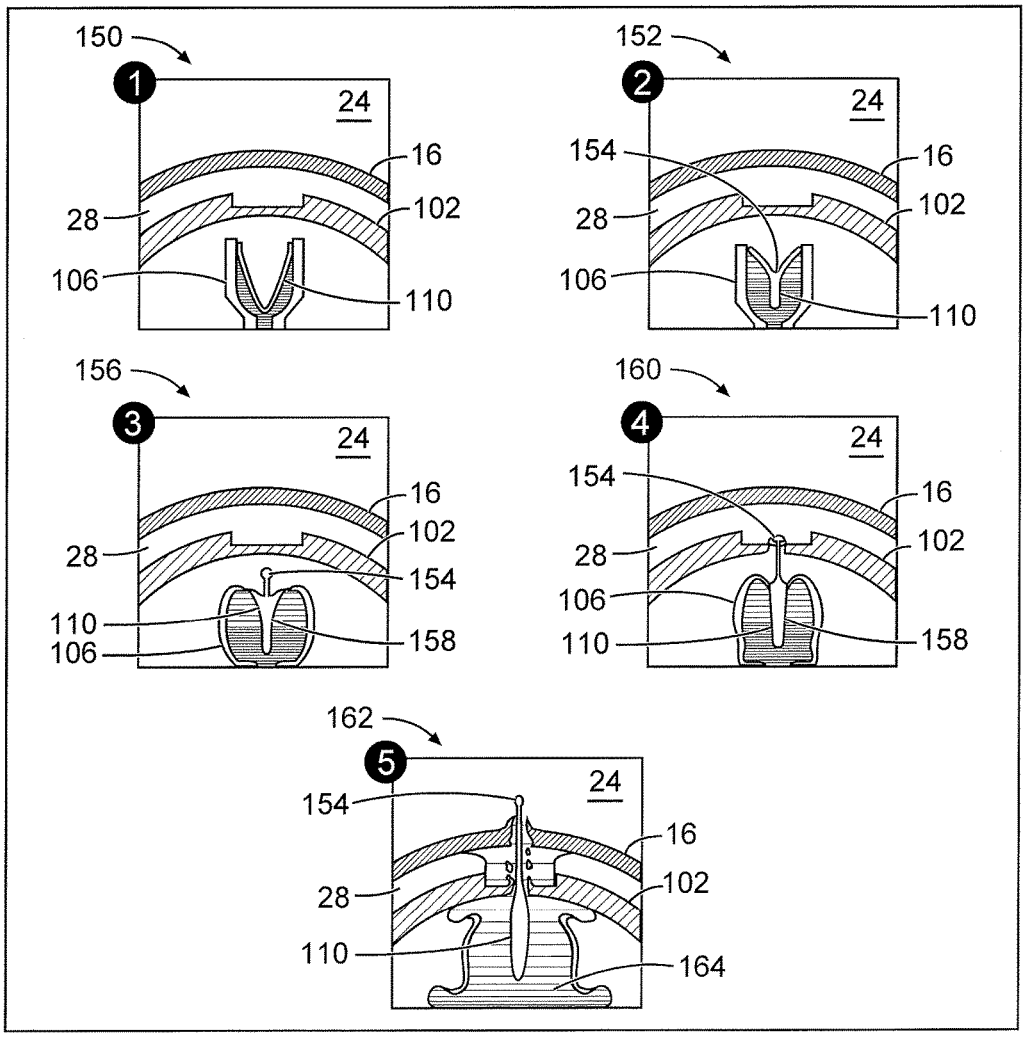
FIG. 4 is a schematic illustration showing stages of detonation of a charge in the perforating system of FIG. 2, in accordance with an embodiment of the present disclosure.

FIG. 4 includes a progression of views of the perforating gun 20, specifically showing one of the shaped charges 106 being detonated to perform a perforation. A first panel 150 illustrates the shaped charge 106 disposed in the carrier gun body 102 prior to detonation. A second panel 152 illustrates the shaped charge 106 once the high explosive powder is detonated. At this point, the liner 110 collapses inward to form a jet 154. As illustrated in a third panel 156, the jet 154 is propelled outward from the discharge end of the shaped charge 106 while the later stages of the liner 110 collapse to form a slower moving slug 158. A fourth panel 160 illustrates the jet 154 stretching toward and penetrating the carrier gun body 102 and moving into the annulus 28 as the slug 158 starts moving outward in the same direction. Finally, as shown in a fifth panel 162, the stretching jet 154 formed by the liner 110 penetrates the casing 16 and the formation 24 beyond, thereby forming a perforation and establishing fluid communication between the subsurface formation 24 and the interior of the casing 16.

As can be seen in the fifth panel 162, any leftover interior components 164 inside the carrier gun body 102 may become damaged in the wake of the explosives pushing outward from the carrier gun body 102. Accordingly, presently disclosed embodiments are directed to a perforating gun with dissolvable internal components, so that the internal components do not later become undesirable debris that blocks additional drilling, recovery, and completion operations.

Returning to FIG. 2, each of the shaped charges 106 is longitudinally and radially aligned with one of the recesses 104 in the carrier gun body 102 when the perforating gun 20 is fully assembled. In the illustrated embodiment, the shaped charges 106 are arranged in a rotating pattern such that each of the shaped charges 106 is disposed on its own level or height and is to be individually detonated so that only one shaped charge 106 is fired at a time. In other embodiments of the perforating gun 20, the shaped charges 106 may be arranged in a spiral or helical pattern to produce the same effect. It should be understood, however, that alternate arrangements of the shaped charges 106 may be used, including cluster type designs wherein more than one shaped charge 106 is at the same level and is detonated at the same time, without departing from the principles of the present invention.

As mentioned above, present embodiments of the perforating gun 20 include dissolvable elements. More specifically, the charge holder 112, the shaped charges 106, and end alignment fixtures 168 are designed to dissolve in response to detonation of the shaped charges 106 and a flow of wellbore fluids through the interior chamber of the carrier gun body 102. The charge holder 112 and the shaped charges 106 may be constructed from a material that is reactive with at least one of the wellbore fluids used in the completion of the wellbore 14. The dissolvable components eliminate undesirable debris from the perforating gun 20 after performing a perforating operation. After these portions of the perforating gun 20 are dissolved, the carrier gun body may be used to perform additional downhole completion activities, as described in detail below.

In the present disclosure, the term "dissolvable components" refers to components that become soluble, break into small pieces, degrade mechanical properties, or change to a fluid upon reacting with a particular material. The components are dissolvable when they break into pieces small enough to be swept out of the perforating gun and/or through the wellbore with the wellbore fluid flowing therethrough. Indeed, upon providing a wellbore fluid to the dissolvable components of the perforating gun 20, these components may react such that they break into small pieces that become dispersed throughout the wellbore fluid. In other embodiments, the dissolvable components may react with the wellbore fluid to produce an entirely different material, such as a fluidic acid that flows out of the perforating gun 20.

The dissolvable charge holder 112, end alignment fixtures 168, and shaped charges 106 may dissolve over time in at least one wellbore fluid delivered into the carrier gun body 102. The explosion or detonation of the shaped charges 106 used to perform the perforations may break up the internal components of the perforating gun 20. Specifically, the shaped charges 106, the charge holder 112, and the end alignment fixture 168 may break into several pieces after the detonation, and fluids from the wellbore 14 may start to rush in after the detonation. This break-up of the perforating gun internals makes the shaped charges 106, the charge holder 112, and the end alignment fixture 168 more easily dissolvable in the wellbore fluid and/or completion fluid delivered to the perforating gun 20. Specifically, the relatively small chunks of these internal gun components provide the wellbore fluid with a higher surface area to volume ratio for the dissolvable components, helping them to dissolve faster than would otherwise be possible.

Having now discussed the general layout of the perforating gun 20, a more detailed explanation of the various materials that may be used to form the dissolvable components is provided. In some embodiments, the perforating gun 20 may include dissolvable components formed from an active metal material. Such metals may be particularly reactive with at least one of the wellbore fluids delivered into the wellbore 14. The internal components of the perforating gun 20 may be made from aluminum, copper, zinc, magnesium, sodium, potassium, or some combination of these materials. In some embodiments, the charge holder 112 may be constructed from a magnesium alloy with aluminum and zinc with an aluminum content between 1% and 9% and a zinc content between 0.3% and 2%. In another embodiment, the charge holder 112 may be constructed from a magnesium alloy with zinc and zirconium with a zinc content between 1% and 9% and a zirconium content between 0.3% and 2%. In one example, the zinc content is approximately 1.5% and the zirconium content is approximately 0.6%. In another example, the zinc content is approximately 6% and the zirconium content is approximately 1%. In another embodiment, the magnesium alloy is constructed from a magnesium alloy with rare earth elements such as yittrium, niobium, and zirconium.

The metallic components may be particularly reactive with certain commonly used wellbore fluids. For example, bromide completion fluids (e.g., calcium bromide) are sometimes employed. Chloride compounds are also found in many wellbore fluids. Magnesium alloys are readily reactive with bromide completion fluids and/or chloride compounds, making the magnesium parts of the perforating gun 20 dissolvable in the bromide fluid or chloride compound. Similarly, high purity aluminum alloys used in the construction of the perforating gun 20 may react well with chloride compounds found in wellbore fluids and/or bromide fluids to dissolve the internal components. Aluminum alloyed with other elements may dissolve in such wellbore fluids as well. These alloys may include, for example, aluminum alloyed with gallium, which will dissolve in a water-based fluid.

Other combinations of wellbore fluids and metallic materials for the charge holder 112 may be tailored to react with one another, depending on the nature of the materials. It may be desirable to utilize charge holders 112 and charges 106 made from alloys that have relatively low resistance to corrosion. This may help to facilitate and speed up the dissolving reaction. Furthermore, in some embodiments, it may be desirable to heat treat the charge holder 112 and/or shaped charges 106, in order to give the microstructure of the metallic materials a larger grain size. This may enhance the corrosion rate of these materials.

Different components of the perforating gun 20 may include different materials. The relative galvanic potential of the different components could increase the rate of dissolution. For example, the gun body 102 may be made primarily of steel while the charge holder 112 may be made of a material with a lower galvanic potential, such as aluminum, zinc, magnesium, or alloys. In another example, the charges 106 include a graphite while the dissolvable components include materials with a lower galvanic potential. In another embodiment, materials with different galvanic potential are mixed into the active material, such as graphite, nickel, copper, iron, or titanium being added to a magnesium alloy or an aluminum alloy.

The active metal can be constructed in a casting process, a forged process, a sintered process, a powdered metallurgy process, a wrought process, an extrusion process, or any of the other known methods for constructing a metal. In one embodiment, the active metal is a nanostructured composite that is formed with a forging process or sintering process. In another embodiment, the active metal is a microgalvanic solution that is formed with a casting process or extrusion process.

In other embodiments, the perforating gun 20 may include dissolvable components formed from degradable polymers. For example, the internal components of the perforating gun 20 may be constructed from polyglycolide (PGA) or blend, which is a degradable thermoplastic that dissolves in water. PGA is a particularly stiff material, possessing a high tensile strength, abrasion resistance, and mechanical properties comparable to or exceeding those of polyether ether ketone (PEEK). The mechanism for dissolving this material comes from an instability of the ester linkage in the polymeric chain of PGA. Once water erodes this ester linkage, the PGA polymer becomes monomer glycolic acid (MGA). As the crystalline portions of the PGA internal perforating gun components degrade, the MGA begins to disperse or flow freely as an acid out of the carrier gun body 102.

Several factors may enhance the dissolvability of PGA, making it particularly suited for use in wellbore applications. For example, the rate of degradation of PGA may be increased in alkaline fluids, which are typically present within wellbore environments. In addition, the rate of degradation of the PGA is generally increased in relatively high temperature environments as well. Since the perforating gun 20 is downhole, it is already in a relatively high temperature environment. Additionally, the detonation of the shaped charges 106 of the perforating gun 20 may increase the temperature to 100s or 1000s of degrees Fahrenheit adjacent to the charge holder 112 and end alignment fixtures XXX, thereby acting as a catalyst for the post-detonation dissolving of the charge holder 112 and end alignment fixtures 168. The resulting acid that forms may flow out of the carrier gun body 102, providing an acid treatment of the wellbore and various downhole components. The PGA perforating gun components may provide this supplemental acid treatment without the perforating gun 20 being removed from the wellbore, saving rig time and money.

It should be noted that other types of degradable polymers may be used in other embodiments of the perforating gun 20. For example, polylactic acid (PLA) is another polymer or blend that is broken down with heat and fluid exposure. As a result of the detonation of the charges 106, PLA components of the perforating gun 20 may turn into acid under the exposure to wellbore fluids and heat. The dissolving behavior described above can be extended to PLA polymers, PGA polymers, or a combination thereof. The dissolving behavior can also be extended to PLA polymers (or PGA polymers) blended with various compounds, such as starch, saccharides, and/or cellulose. Other degradable polymers will degrade with exposure to hydrocarbons, to acids fluids, or to alkaline fluids.

In some embodiments of the perforating gun 20, the charge holder 112 may be constructed from sodium borate, salt, or alkali metals. These materials contain alkali metals, making them readily soluble in fresh water by salinity. Accordingly, these materials are dissolvable in water-based wellbore fluids, either delivered from the surface or produced from the formation. In addition, sodium borate is reactive with hydrochloric acid (HCl) to form boric acid. Thus, a charge holder 112 constructed from sodium borate may be used in a perforating operation, and a wellbore fluid including HCl may be delivered down into the perforating gun 20 to react with the charge holder 112, thereby providing an acid treatment of boric acid to the recently perforated formation. Sodium borate may also be used for the charge holder 112 in order to provide a crosslinking agent in a diverting fluid gel, in order to control fluid loss or create a temporary well barrier after a perforating operation and prior to subsequent operations. Gels (e.g., fluid diverting gels) normally consist of a buffering agent, a crosslinking agent (e.g., sodium borate), and a gelling agent. After perforating the formation, a gelling agent and a buffering agent may be pumped down the tool string and into the perforating gun 20 where they can mix with the debris from the dissolved charge holder 112. This mixes the gelling agent, the buffering agent, and the crosslinking agent (e.g., sodium borate) to form a gel barrier. This may be particularly desirable if formation fluid begins to rush into the reservoir after perforating (e.g., due to lost circulating fluid). The gel formed by the agents reacting with the sodium borate may temporarily plug the fresh perforations while subsequent screening or gravel packing workstrings are moved into place. It should be noted that PGA or PLA could be similarly used as crosslinking agents in other embodiments.

In some embodiments of the perforating gun 20 having the charge holder 112 and/or other internal components constructed from an active metal material, the dissolvable components may also include an anhydrous acid or anhydrous base placed proximate the dissolvable metal. When wellbore fluids are delivered into the perforating gun 20 after performing the perforations, the wellbore fluid may react with the anhydrous acid or base to perform the dissolving reaction of the metal components. That is, the wellbore fluid hydrates the anhydrous material to form an acidified wellbore fluid. The acidified wellbore fluid then enhances the degradation rate of the dissolvable metal material. Examples of anhydrous acids may include both organic acids and inorganic acids such as citric acid, boric acid, carboxylic acid, sulfonic acid, hydrochloric acid, and so forth.

In still further embodiments, a degradable polymer may be used in conjunction with a dissolvable metal to form the dissolvable components of the perforating gun 20. The different types of material may degrade into acids or bases that enhance the degradation of the other materials. For example, in some embodiments, the degradable polymer may generate an acid upon reacting with the wellbore fluid, and this acid may help in the dissolution of the metal. In other embodiments, the dissolvable metal may react with the wellbore fluids to generate a base that helps in the degradation of the polymer.

Depending on the desired effect of the dissolvable materials and the wellbore fluids in use, any desirable combination of the components described above may be used to form the dissolvable components of the perforating gun 20. For example, if bromide completion fluids are being used, then the dissolvable materials may include a relatively large amount of magnesium. As another example, if a supplemental acid treatment is desired, the dissolvable components may include PGA or PLA. However, it should be noted that other types of materials besides those listed herein may be combined to make dissolvable gun components that yield a desired effect.

It should be noted that, in some embodiments, the dissolvable components may be used to construct the carrier gun body 102, in addition to the internal charge holder 112, charges 106, and end alignment fixtures 168. This would make the entire perforating gun 20 dissolvable. In such embodiments, the carrier gun body 102 may be made from dissolvable materials (e.g., active metals or degradable polymers) and coated with epoxy, thin metal liner, paint, plastic coating, or resin that is resistant to undesirable wellbore fluids. That way, the carrier gun body 102 may not dissolve until the perforation is completed, allowing production fluids from the formation as well as wellbore and/or completion fluids pumped down from the surface flow into the carrier gun body 102, dissolving all the components of the perforating gun 20 from the inside out. In some embodiments, additional carriers and connectors 170 coupled to the carrier gun body 102 may be constructed from the dissolvable materials as well. These carriers and connectors 170 may be reactive with wellbore fluids after the perforating event, providing an entirely disappearing perforating gun string. Since the entire perforating gun 20 may be dissolvable, this enables the later use of the tubular string above the perforating gun 20 to perform additional completion services without the removal of the tubular string from the wellbore.

Figure 5:
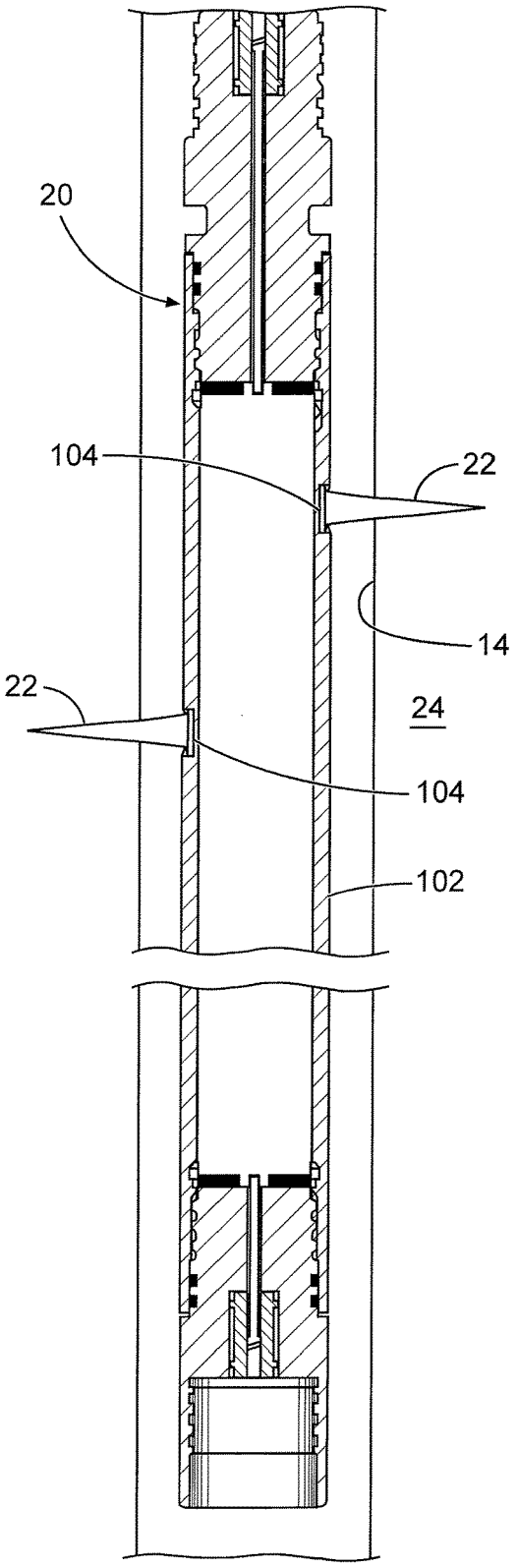
FIG. 5 is a schematic view of the perforating system of FIG. 2 after internal components of the perforating system are dissolved, in accordance with an embodiment of the present disclosure.

Even when just the internal components of the perforating gun 20 are dissolved after the perforating event, the leftover carrier gun body 102 may be used to perform additional completion operations inside the wellbore. For example, FIG. 5 illustrates the perforating gun 20 of FIG. 2 after the charge holder 112, end alignment fixtures 168 and shaped charges 106 have been dissolved in wellbore fluid. As illustrated in FIG. 5, a perforating event from the perforating gun 20 leaves several perforations 22 extending into the formation 24 and aligned with respective recesses 104 of the carrier gun body 102. In addition, the only part of the perforating gun 20 left in the illustrated embodiment is the carrier gun body 102, although as noted above other embodiments of the perforating gun 20 may have a dissolvable carrier gun body 102.

In the illustrated embodiment, the perforating gun 20 may be combined with traditional tubing and coupling style connections that allow a flow of fluids from the surface into the perforating gun 20. This may allow the perforating gun 20 to perform post-perforating operations in the wellbore 14. For example, the perforating gun 20 may be integrated into a production string, which is generally used to direct a flow of formation fluids from the formation 24 to the surface. After the internal components of the perforating gun 20 are dissolved, the remaining portion (e.g., carrier gun body 102) of the perforating gun 20 would become open tubing for producing hydrocarbons from the perforated formation 24. The hydrocarbons could easily flow from the formation 24 into the carrier gun body 102, since the perforations 22 through the formation 24 are aligned with the now opened recesses 104 of the carrier gun body 102.

In other embodiments, the perforating gun 20 may facilitate chemical treatments (e.g., acid treatment) and fracking operations after performing the initial perforating operation. For example, the perforating gun 20 may include water soluble polymer parts that dissolve into an acid, thereby providing an acid treatment directly to the formation 24 through the perforations 22. In other embodiments, after the perforating event is completed and the internal components of the perforating gun 20 are dissolved, the carrier gun body 102 may serve as a conduit for fracking fluids that are directed through the aligned recesses 104 and into the already formed perforations 22 of the formation 24. Indeed, the carrier gun body 102 may function, after perforation, as a conduit with direct access to the perforated sections of the formation 24.

Figure 6:
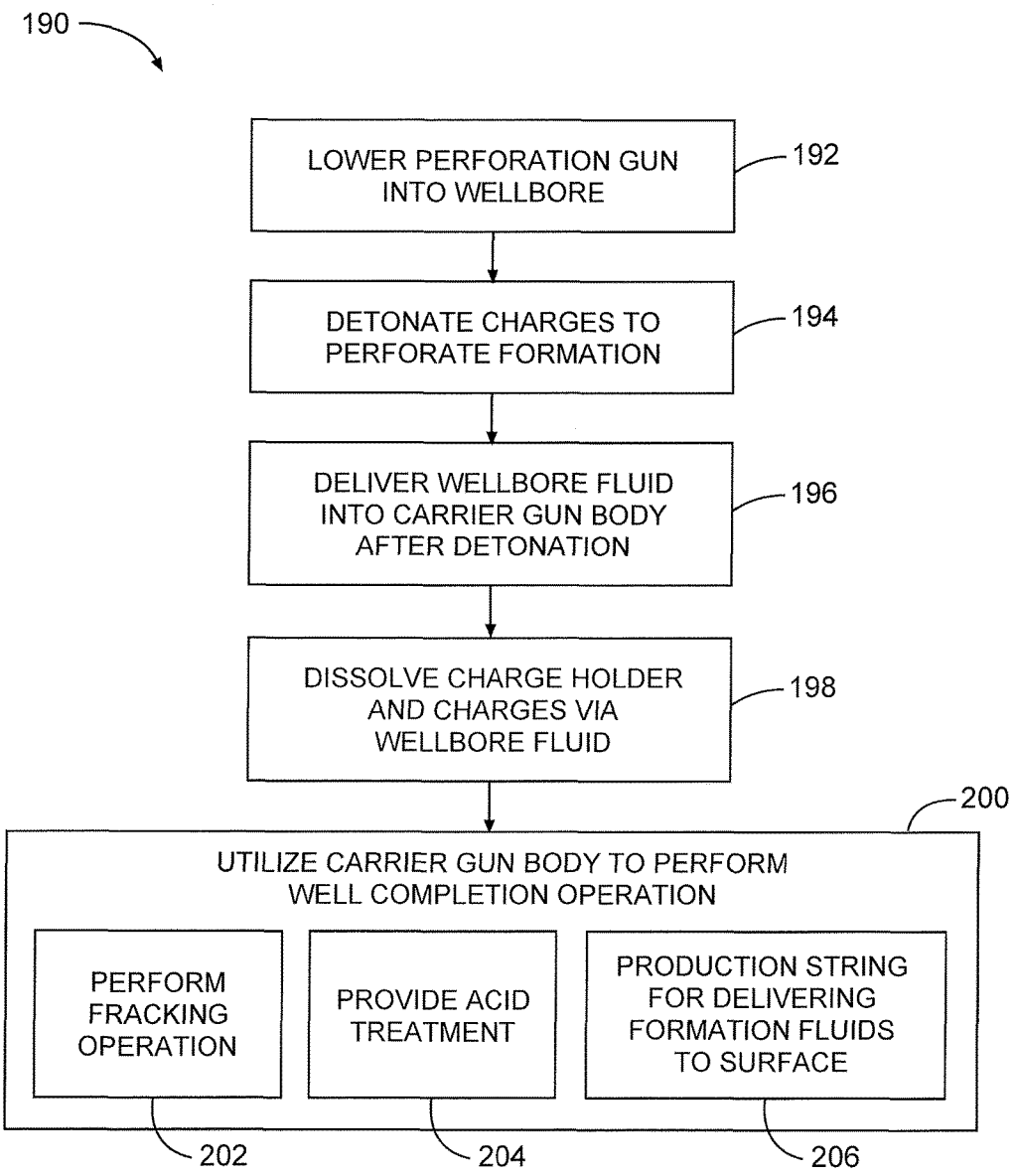
FIG. 6 is a process flow diagram of a method for operating the perforating system of FIG. 2, in accordance with an embodiment of the present disclosure.

FIG. 6 is a process flow diagram illustrating a method 190 for perforating a subterranean formation using the perforating gun 20 of FIG. 2 described above. The method 190 includes lowering (block 192) the disclosed perforating gun 20 into a wellbore. The perforating gun 20 may be conveyed via a wireline, slickline, coiled tubing, or tubing string. The method 190 also includes detonating (block 194) a plurality of charges to perforate the subterranean formation. In addition, the method 190 includes delivering (block 196) wellbore fluid into the carrier gun body after detonation of the charges. Further, the method 190 includes dissolving (block 198) the charge holder and the charges via the wellbore fluid delivered to the tool.

In some embodiments, the method 190 may further include utilizing (block 200) the leftover carrier gun body to perform a well completion activity without pulling the perforating gun 20 from the wellbore. For example, this might include performing a fracking operation (block 202), providing an acid treatment (block 204), or utilizing the carrier gun body as part of the production string (block 206) for delivering formation fluids from the formation to the surface of the wellbore. Other types of in situ completion or production operations may be performed using parts of the perforating gun 20 leftover after performing the perforations and dissolving certain components of the perforating gun 20. For example, as discussed above, the dissolved parts of the perforating gun 20 may react with certain wellbore fluids to form a gel, thus enabling a temporary well barrier operation.

Although the present disclosure and its advantages have been described in detail, it should be understood that various changes, substitutions and alterations can be made herein without departing from the spirit and scope of the disclosure as defined by the following claims.

What is claimed is:

1. A perforating system for perforating a subterranean formation, comprising:

a carrier gun body comprising a cylindrical sleeve having a plurality of radially reduced areas disposed thereabout;

a charge holder disposed in the cylindrical sleeve of the carrier gun body;

a plurality of charges disposed on the charge holder, wherein each of the plurality of charges is aligned with a corresponding one of the plurality of radially reduced areas of the carrier gun body;

wherein the charge holder is dissolvable in at least one wellbore fluid delivered through the carrier gun body after detonation of the plurality of charges, wherein the charge holder comprises a dissolvable active metal material; and an anhydrous acid or anhydrous base placed proximate the active metal material of the charge holder, wherein the at least one wellbore fluid reacts with the anhydrous acid or anhydrous base to perform the dissolving reaction of the metal charge holder;

wherein the carrier gun body facilitates flow of one or more fluids through a wellbore to perform a well completion after the charge holder is dissolved.

2. The perforating system of claim 1, wherein the plurality of charges are dissolvable in the at least one wellbore fluid delivered through the carrier gun body after detonation of the plurality of charges.

3. The perforating system of claim 1, wherein the plurality of charges comprise materials that are reactive with explosives in order to dissolve the plurality of charges after detonation of the plurality of charges.

4. The perforating system of claim 1, wherein the charge holder comprises aluminum, copper, zinc, magnesium, sodium, potassium, or a combination thereof.

5. The perforating system of claim 1, wherein the charge holder comprises a magnesium alloy and the at least one wellbore fluid comprises one of a bromide fluid or a chloride compound.

6. The perforating system of claim 1, wherein the charge holder comprises an aluminum alloy and the at least one wellbore fluid comprises one of a chloride compound or a bromide fluid.

7. The perforating system of claim 1, wherein the anhydrous acid or anhydrous base comprises an anhydrous acid.

8. The perforating system of claim 7, wherein the anhydrous acid comprises citric acid, boric acid, carboxylic acid, sulfonic acid, or hydrochloric acid.

9. The perforating system of claim 1, wherein the carrier gun body is constructed from a material with a first galvanic potential, the charge holder is constructed from a material with a second galvanic potential different from the first galvanic potential.

10. The perforating system of claim 9, wherein the plurality of charges are constructed from a material with a third galvanic potential different from the first and second galvanic potentials.

11. The perforating system of claim 1, wherein the cylindrical sleeve comprises a material that is dissolvable in the at least one wellbore fluid delivered through the carrier gun body after detonation of the plurality of charges, the perforating system further comprising a coating disposed around the dissolvable cylindrical sleeve, the coating being resistant to wellbore fluids such that the cylindrical sleeve does not dissolve in wellbore fluids until after detonation of the plurality of charges.

12. A perforating system for perforating a subterranean formation, comprising:

a tubular string;

a carrier gun body coupled to a distal end of the tubular string, wherein the carrier gun body comprises a cylindrical sleeve;

a charge holder disposed in the cylindrical sleeve of the carrier gun body; and a plurality of charges disposed on the charge holder;

wherein the charge holder and the plurality of charges are dissolvable during detonation of the plurality of charges and during communication of at least one wellbore fluid through the carrier gun body after detonation of the plurality of charges;

wherein the charge holder comprises a dissolvable active metal material;

an anhydrous acid or anhydrous base placed proximate the active metal material, wherein the at least one wellbore fluid reacts with the anhydrous acid or anhydrous base to perform the dissolving reaction of the metal charge holder;

wherein the cylindrical sleeve comprises a material that is dissolvable in the at least one wellbore fluid delivered through the carrier gun body after detonation of the plurality of charges; and a coating disposed around the dissolvable cylindrical sleeve, wherein the coating is resistant to wellbore fluids such that the cylindrical sleeve does not dissolve in wellbore fluids until after detonation of the plurality of charges.

13. The perforating system of claim 12, wherein the carrier gun body facilitates flow of fracturing fluid from a surface through the tubular string and into the subterranean formation.

14. The perforating system of claim 12, wherein the coating comprises epoxy, a thin metal liner, paint, plastic, resin, or a combination thereof.

15. A method for perforating a subterranean formation, comprising:

lowering a perforating gun into a wellbore, the perforating gun comprising a carrier gun body having a cylindrical sleeve, a charge holder disposed in the cylindrical sleeve, and a plurality of charges disposed on the charge holder;

the charge holder comprising a dissolvable active metal material;

wherein the perforating gun further comprises an anhydrous acid placed proximate the active metal material of the charge holder;

detonating the plurality of charges to perforate the subterranean formation;

delivering wellbore fluid into the carrier gun body after detonation of the plurality of charges;

hydrating the anhydrous acid via the wellbore fluid to form an acidized wellbore fluid;

dissolving the charge holder;

enhancing the degradation rate of the dissolvable active metal material via the acidized wellbore fluid; and utilizing the carrier gun body to perform a well completion without pulling the perforating gun out of the wellbore.

16. The method of claim 15, further comprising dissolving the plurality of charges via the wellbore fluid.

17. The method of claim 15, wherein the well completion comprises a fracking operation, temporary well barrier operation, an acid treatment, or a combination thereof.

18. The method of claim 15, wherein utilizing the carrier gun body to perform a well completion comprises utilizing the carrier gun body as part of a production string for delivering formation fluids from the subterranean formation to a surface of the wellbore.

* * * * *